US007398789B1

(12) United States Patent
Herrera

(10) Patent No.: US 7,398,789 B1
(45) Date of Patent: Jul. 15, 2008

(54) DUMPSTER CLEANING APPARATUS

(76) Inventor: Sheila Herrera, 1338 Woodland Dr., Bloomfield, NM (US) 87413

( * ) Notice: Subject to any disclaimer, the term of this patent is extended or adjusted under 35 U.S.C. 154(b) by 384 days.

(21) Appl. No.: 11/140,378

(22) Filed: May 27, 2005

(51) Int. Cl.
*B08B 3/02* (2006.01)

(52) U.S. Cl. ..... 134/166 R; 134/169 R; 134/115

(58) Field of Classification Search ..... 134/166 R, 134/169 R, 115, 201
See application file for complete search history.

(56) References Cited

U.S. PATENT DOCUMENTS

| | | | | | |
|---|---|---|---|---|---|
| 2,853,240 | A | * | 9/1958 | Mahoney, Jr. | 241/41 |
| 3,212,511 | A | * | 10/1965 | Cuillier | 134/107 |
| 3,291,144 | A | * | 12/1966 | Diamond | 134/104.1 |
| 3,549,092 | A | * | 12/1970 | Baxter, Jr. | 241/15 |
| 3,688,782 | A | | 9/1972 | Smith | |
| 3,881,950 | A | | 5/1975 | Pettit | |
| 3,901,255 | A | * | 8/1975 | Pettit | 134/107 |
| 4,133,340 | A | | 1/1979 | Ballard | |
| 4,211,745 | A | | 7/1980 | Boyd | |
| 4,242,311 | A | | 12/1980 | Middaugh | |
| 4,461,607 | A | | 7/1984 | Smith | |
| 4,694,846 | A | | 9/1987 | Bouchard | |
| 4,907,747 | A | | 3/1990 | Kim | |
| 5,846,044 | A | | 12/1998 | Smith et al. | |
| 5,964,229 | A | | 10/1999 | Brendel | |
| 6,336,239 | B1 | | 1/2002 | Cooper | |
| 6,554,008 | B2 | | 4/2003 | Dewey et al. | |
| 6,758,225 | B2 | | 7/2004 | Thompson et al. | |
| 7,144,550 | B2 | * | 12/2006 | Devine et al. | 422/28 |
| 7,225,816 | B2 | * | 6/2007 | Byers | 134/22.1 |

FOREIGN PATENT DOCUMENTS

| | | | |
|---|---|---|---|
| DE | 1 924 562 | * | 11/1970 |
| DE | 25 36 774 | * | 3/1977 |
| DE | 31 33 073 | * | 3/1983 |
| DE | 296 15 431 | * | 10/1996 |
| DE | 199 20 210 | * | 11/2000 |
| DE | 199 55 977 | * | 6/2001 |
| FR | 2 590 241 | * | 5/1987 |

OTHER PUBLICATIONS

European Patent Office 0 937 510 Aug. 1999.*

* cited by examiner

*Primary Examiner*—Frankie L Stinson

(57) ABSTRACT

A dumpster cleaning apparatus for cleaning and deodorizing a garbage container. The dumpster cleaning apparatus includes a vehicle for traveling across a support surface. A washing assembly mounted on the vehicle for washing the garbage container. A lifting means mounted to the vehicle for lifting the garbage container from the support surface and positioning the garbage container in the washing assembly so that the washing assembly can wash the garbage container.

17 Claims, 5 Drawing Sheets

DUMPSTER CLEANING APPARATUS

BACKGROUND OF THE INVENTION

1. Field of the Invention

The present invention relates to trash bin cleaning systems and more particularly pertains to a new dumpster cleaning apparatus for thoroughly cleaning and deodorizing a garbage container in a highly automated manner.

2. Description of the Prior Art

The use of trash bin cleaning systems is known in the prior art. U.S. Pat. Nos. 6,336,239 and 3,291,144 each generally show a bin washer that cleans the interior of the bin, but fails to clean the exterior of the bin being washed. U.S. Pat. Nos. 4,694,846; 3,881,950; 3,901,255; 4,211,745; 4,242,311, 5,964,229; 6,554,008; 6,758,225 and 4,907,747 each generally show a system for washing a trash bin that is unable to reclaim the fluid used to clean the wash bins and recycle that fluid to clean subsequent trash bins. U.S. Pat. Nos. 4,133,340; 3,688,782 and 3,212,511 each generally show a system for cleaning a hollow article, but each system requires that the article to be cleaned be sealed within the washing structure to clean the article, thereby adding additional time and steps required to effect the cleaning process. U.S. Pat. Nos. 4,461, 607 and 5,846,044 each generally show a system for lifting a refuse container, but fail to provide any cleaning of the refuse container once the refuse container has been lifted by the system.

In these respects, the dumpster cleaning apparatus according to the present invention substantially departs from the conventional concepts and designs and limitations of the prior art systems, and in so doing provides an apparatus primarily developed for the purpose of thoroughly cleaning and deodorizing a garbage container in a highly automated manner

SUMMARY OF THE INVENTION

In view of the foregoing disadvantages inherent in the known types of trash bin cleaning systems now present in the prior art, the present invention provides a new dumpster cleaning apparatus construction wherein the same can be utilized for cleaning and deodorizing a garbage container in a highly automated manner.

To attain this, the present invention generally comprises a washing assembly for mounting on a vehicle resting on a support surface. The washing assembly is capable of washing both an interior and an exterior of the garbage container. The invention further comprises a lifting means for lifting the garbage container from the support surface and positioning the garbage container in the washing assembly. The lifting means is mountable on the vehicle with the washing assembly.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

One significant advantage of the present invention is the capability to clean and deodorize both the interior and exterior of garbage containers to keep the garbage containers clean and prevent odors forming from the decomposition of debris on the garbage container.

Another significant advantage of the present invention is the recycling of the fluid used to clean the garbage containers and passing the fluid through a series of steps to remove the debris from the fluid thereby providing a more efficient use of the fluid required to clean a series of garbage containers. The more efficient use of the cleaning fluid reduces concerns about pollution resulting from disposal of large amounts of the used cleaning fluid.

Further advantages of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects of the invention will become apparent when consideration is given to the following detailed description thereof. Such description makes reference to the annexed drawings wherein.

DESCRIPTION OF PREFERRED EMBODIMENTS

Figure 1:
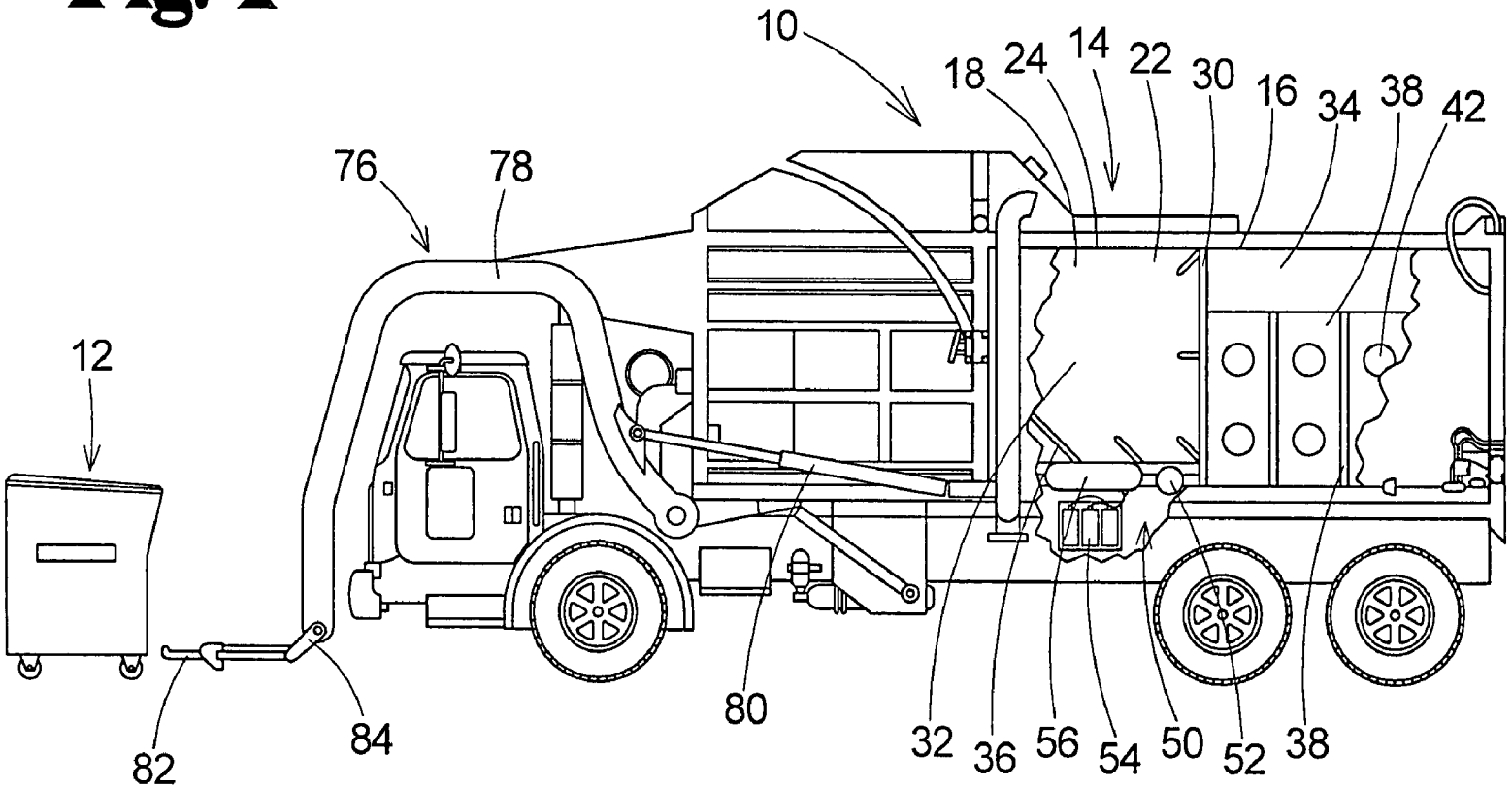
FIG. 1 is a left side view of a new dumpster cleaning apparatus according to the present invention.
Figure 2:
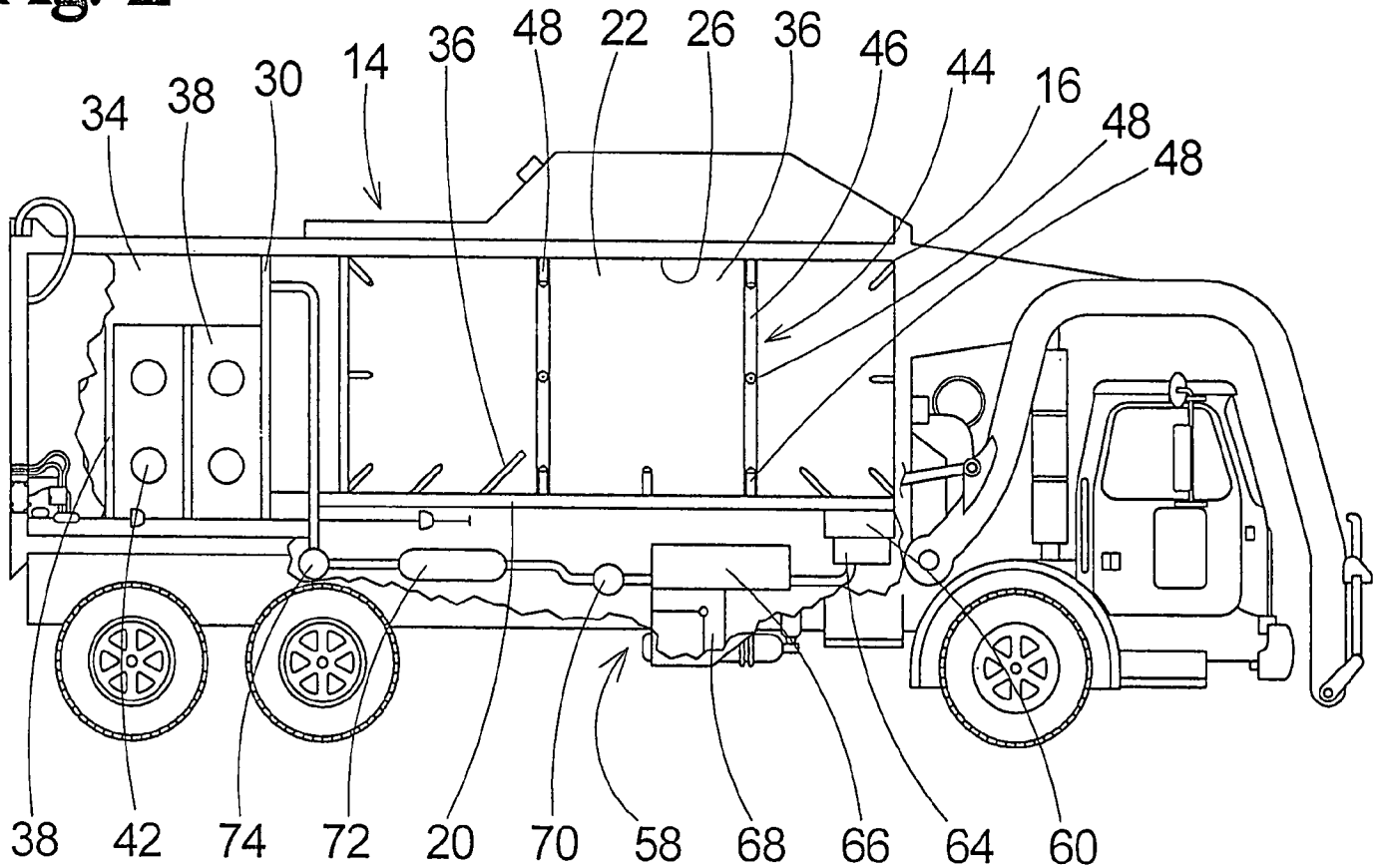
FIG. 2 is a right side view of the present invention.
Figure 3:
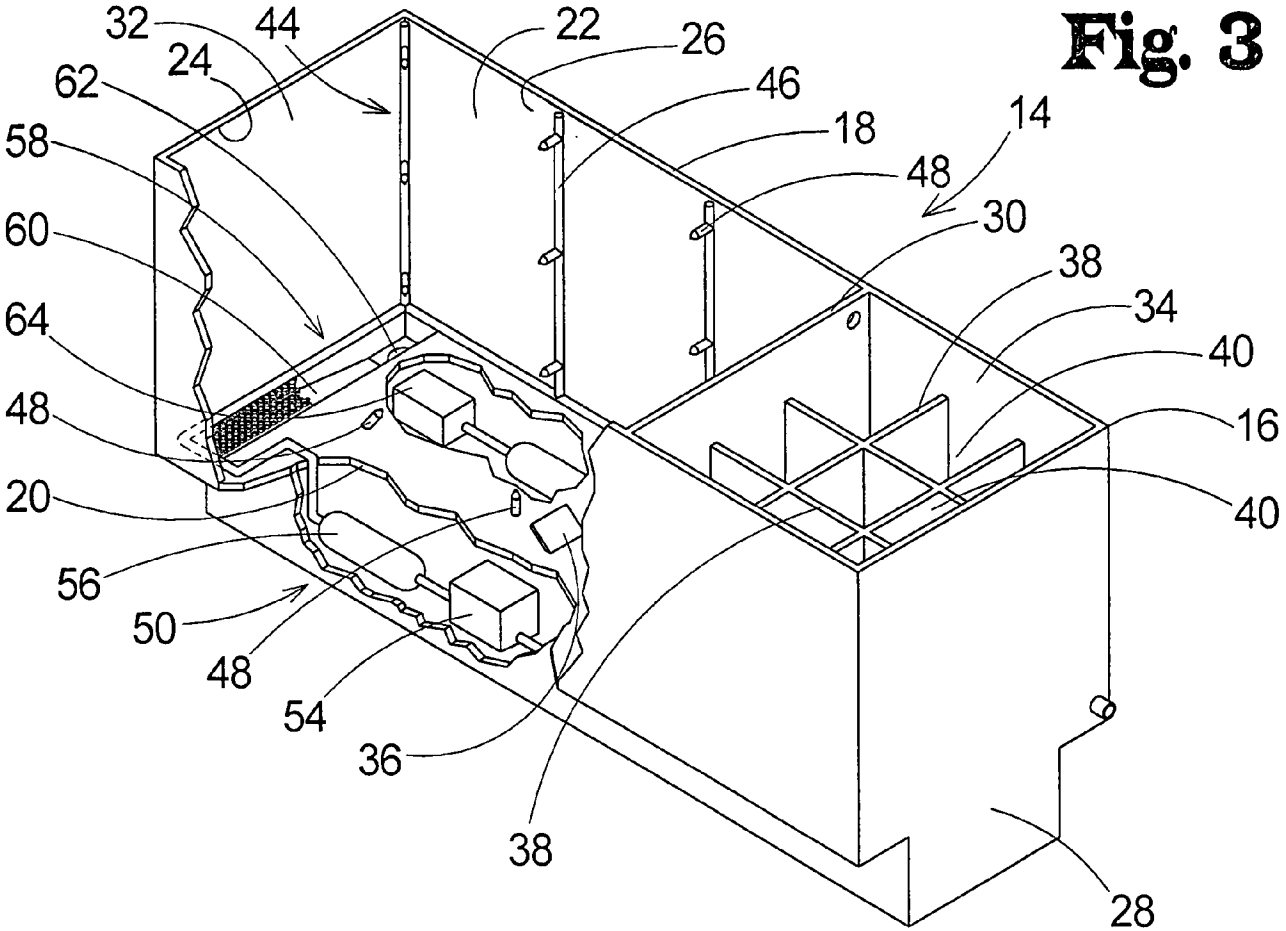
FIG. 3 is a perspective view of the washing assembly of the present invention.

With reference now to the drawings, and in particular to FIGS. 1 through 5 thereof, a new dumpster cleaning apparatus embodying the principles and concepts of the present invention and generally designated by the reference numeral 10 will be described.

As best illustrated in FIGS. 1 through 5, the dumpster cleaning apparatus 10 is highly suitable for mounting on a vehicle for traveling across a support surface.

The apparatus 10 is used with a garbage container 12 or dumpster conventionally used for receiving and holding garbage. The garbage container 12 may have a container 12 portion with an upper opening 26, and a lid pivotally mounted on the container 12 portion for selectively closing the upper opening 26 of the garbage container 12 to keep garbage in the container 12 portion.

A washing assembly 14 is mounted on the vehicle for washing the garbage container 12. The washing assembly 14 comprises a washing bin 16 that is mountable on the vehicle. The washing bin 16 comprises a perimeter wall 18 and a base wall 20 that together define an interior space 22 of the washing bin 16. An upper edge 24 of the perimeter wall 18 defines an upper opening 26 of the washing bin 16, and the upper opening 26 and the interior space 22 of the washing bin 16 are sufficiently large enough to permit the garbage container 12 to be removably inserted into the interior space 22 of the washing bin 16. The washing assembly 14 may comprise an alignment member 28 that extends downwardly from the washing bin 16. The alignment member 28 is positionable between the frame rails of the vehicle to maintain alignment of the washing bin 16 with respect to the vehicle.

The washing assembly 14 further comprises a dividing wall 30 coupled to the perimeter wall 18 of the washing bin 16 so that the dividing wall 30 divides the interior space 22 into a washing space 32 and a fluid space 34. The washing space 32 removably receives the garbage container 12 during the washing process. The fluid space 34 is in fluid communication with the washing space 32 to allow the fluid in the fluid space 34 to be used to clean the garbage container 12 in the washing space 32.

The washing assembly 14 may comprise a flap member 36 coupled to the perimeter wall 18 of the washing bin 16. The flap member 36 extends upwardly into the washing space 32. The flap member 36 extends at an angle from about 10 degrees to about 80 degrees with respect to the base wall 20 of the washing bin 16. The flap member 36 engages a lid of the garbage container 12 when the garbage container 12 is positioned in the washing space 32 to force the lid away from the garbage container 12 to keep the garbage container 12 lid open.

The washing assembly 14 may comprise a plurality of baffle walls 38 for dampening movement of the fluid in the fluid space 34. The plurality of baffle walls 38 is positioned in the fluid space 34 for defining a plurality of compartments 40 in the fluid space 34. The baffle walls 38 are coupled to the perimeter wall 18 and the dividing wall 30 to inhibit the fluid from sloshing from side to side when, for example, the vehicle is moving, and inadvertently tipping the vehicle. Each of the baffle walls 38 includes at least one aperture 42 extending through the associated one of the baffle walls 38 to permit the fluid to pass through the associated one of the baffle walls 38 to permit a depth of the fluid to remain substantially uniform in the fluid space 34.

The washing assembly 14 comprises a plurality of nozzle assemblies 44 for directing fluid taken from the fluid space 34 onto the garbage container 12 when it is positioned in the washing space 32 to clean the garbage container 12. The nozzle assemblies 44 are positioned in the washing space 32 of the washing bin 16. The nozzle assemblies 44 are positioned along the perimeter of the washing bin 16 in a manner such that the nozzle assemblies 44 are directed generally inwardly into the washing space 32. The nozzle assemblies 44 are in fluid communication with the fluid space 34 of the washing bin 16.

Each of the nozzle assemblies 44 comprises at least one stanchion conduit 46 in fluid communication with the fluid space 34. The stanchion conduit 46 is coupled to the perimeter wall 18 of the washing bin 16.

Each of the nozzle assemblies 44 further comprises a plurality of nozzles 48 for spraying fluid into the washing space 32. A portion of the plurality of nozzles 48 is coupled to the stanchion conduit 46 so that the nozzles 48 coupled to the stanchion conduit 46 are in fluid communication with flow in the stanchion conduit 46. The nozzles 48 coupled to the stanchion conduit 46 are positioned at divergent angles to the stanchion conduit 46 to allow fluid sprayed from the nozzles 48 to be sprayed into the interior and onto the exterior of the garbage container 12. Optimally, there would be at least three nozzles 48 coupled to the at least one stanchion member and positioned at varying heights, although more or fewer nozzles 48 could be employed. The lowest of the nozzles 48 is generally angled upwardly to spray the fluid into the interior of the garbage container 12. One of the nozzles 48 is positioned medially on the stanchion conduit 46 to spray the side of the exterior of the garbage container 12. Two additional nozzles 48 may be positioned proximate to the top of the stanchion conduit 46 for spraying fluid on the bottom of the inverted garbage container 12. A portion of the plurality of nozzles 48 of the nozzle assemblies 44 may be mounted to the base wall 20 of the washing bin 16 and in fluid communication with the fluid space 34 for spraying water upwardly from the base wall 20 and into the interior of the garbage container 12.

The washing assembly 14 comprises a supply assembly 50 for supplying fluid from the fluid space 34 to the nozzle assemblies 44. The supply assembly 50 is in fluid communication with the fluid space 34 and the nozzle assemblies 44. The supply assembly 50 may be positioned under the wash bin and positioned proximate to the frame rails of the vehicle to allow the body of the vehicle to provide protection for the supply assembly 50.

The supply assembly 50 may comprise a supply pump 52 for pumping the fluid from the fluid space 34 to the nozzle assemblies 44. The supply pump 52 is in fluid communication with the fluid space 34 of the washing bin 16.

The supply assembly 50 may comprise a mixing member 54 for mixing chemicals with the fluid to facilitate cleaning, deodorizing and sanitizing the garbage container 12. The mixing member 54 is in fluid communication with the supply pump 52 and the nozzle assemblies 44.

The supply assembly 50 may also comprise a pressurizing device 56 for pressurizing the fluid being supplied to the nozzle assemblies 44 after the fluid has passed through the mixing member 54. The pressurizing of the fluid by the pressurizing device 56 is desirable to overcome any pressure loss that occurs during the mixing process.

The washing assembly 14 further comprises a return assembly 58 for returning fluid from the washing space. 32 to the fluid space 34 when the fluid has been used to clean the garbage container 12. The return assembly 58 may be positioned under the wash bin and positioned proximate the frame rails of the vehicle to allow the body of the vehicle to provide protection for the return assembly 58.

The return assembly 58 comprises a drain trough 60 being coupled to the base wall 20 of the washing bin 16 in a manner such that the drain trough 60 is in fluid communication with the washing space 32. The base wall 20 of the washing bin 16 is angled downwardly towards the drain trough 60 to move debris washed from the garbage container 12 and fluid dispensed from the nozzle assemblies 44 into the washing space 32 toward the drain trough 60 to collect the fluid. The drain trough 60 may have a bottom wall that slopes downwardly to a drain aperture 62 to direct the fluid and the debris collected in the drain trough 60 to the drain aperture 62.

The return assembly 58 may comprise a grinding member 64 for grinding the debris washed from the garbage container 12 and collected with the fluid from the washing space 32. The grinding member 64 is coupled to the drain trough 60 whereby the grinding member 64 is in fluid communication with the drain aperture 62 of the drain trough 60. A magnet may be positioned between the drain trough 60 and the grinding member 64 for retrieving metal from the debris to inhibit the metal from being engaged by the grinder member and possibly damaging the grinder member.

The return assembly 58 may comprise a separator member 66 for separating the debris that has been ground up by the grinding member 64 from the fluid. The separator member 66 is in fluid communication with the grinding member 64 for receiving flow from the grinding member 64.

The return assembly 58 may further comprise a debris collection member 68 being coupled to the separator member 66 for collecting the debris separated from the fluid by the separator member 66 and storing the debris for disposal. The debris collection member 68 may be positioned below the separator member 66 to allow the debris, with a majority of the debris being heavier than the fluid, to settle into the debris collection member 68 for disposal.

The return assembly 58 comprises a return primary pump 70 being in fluid communication with the separator member 66 for pumping the fluid from the separator member 66 to the fluid space 34 of the washing bin 16.

The return assembly 58 may comprise a particulate filter 72 being in fluid communication with the return primary pump 70 and the fluid space 34 for removing particulate matter from the fluid from the separator member 66.

The return assembly 58 may comprise a return secondary pump 74 being in fluid communication with the particulate filter 72 and the fluid space 34 to pump the filtered water to the fluid space 34.

The apparatus 10 may also include a lifting means 76 for lifting the garbage container 12 from the support surface and positioning the garbage container 12 in the washing space 32 of the washing bin 16. The lifting means 76 is capable of being mounted on the vehicle.

The lifting means 76 may comprise a pair of arms 78 being pivotally coupled to the vehicle so that the arms 78 are pivotable with respect to the vehicle.

The lifting means 76 further comprises an actuating means 80 for pivoting the pair of arms 78 with respect to the vehicle. The actuating means 80 may comprise a pair of hydraulic piston-cylinder assemblies. Each of the hydraulic piston-cylinder assemblies is mounted on one of the arms 78.

The lifting means 76 may also comprise a plurality of forks 82 for inserting into receiving slots of the garbage container 12. The forks 82 are coupled to the arms 78 to lift the garbage container 12 over the vehicle and into the washing space 32 of the washing bin 16.

The lifting means 76 comprises a pair of connecting members 84 for mounting the forks 82 to the arms 78. The connecting members 84 extend between the arms 78 and the forks 82. The connecting members 84 extend through a pair of arcuate cutouts extending through the perimeter wall 18 of the washing bin 16 to permit the arms 78 to be positioned outside of the washing bin 16 when the forks 82 and the garbage container 12 are positioned in the washing space 32 of the washing bin 16.

Figure 4:
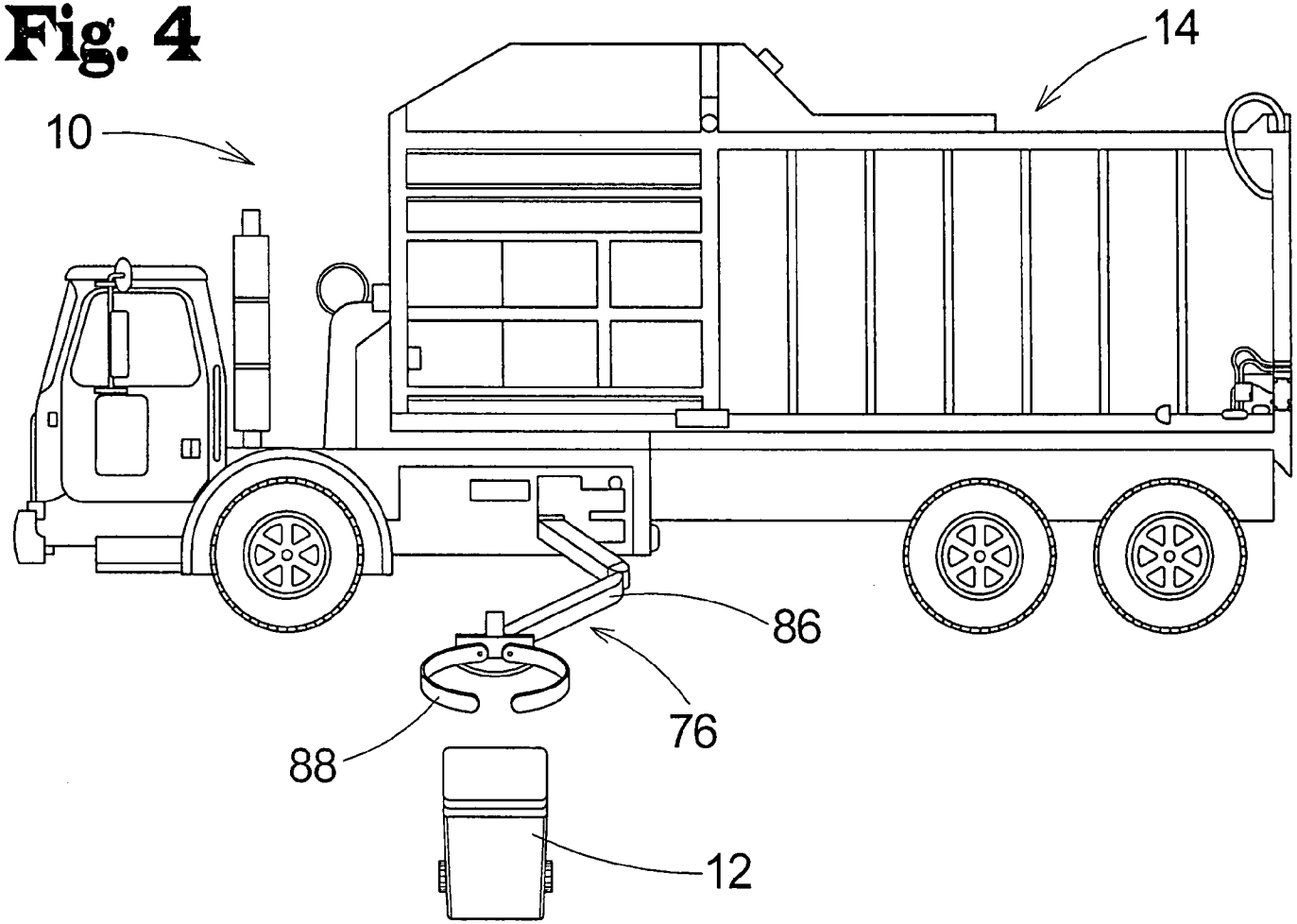
FIG. 4 is a left side view of the present invention showing the alternate embodiment of the lifting means.
Figure 5:
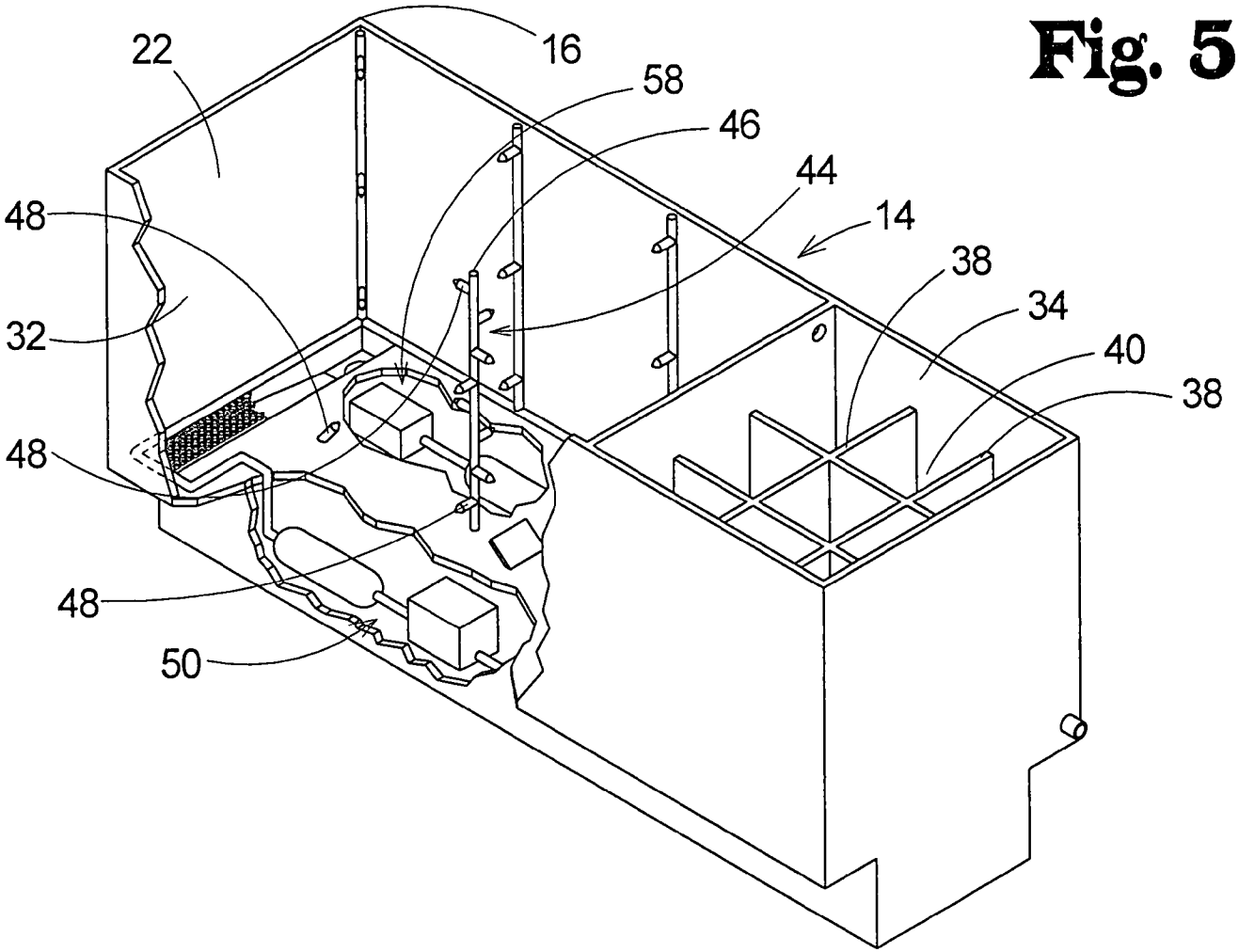
FIG. 5 is a perspective view of the present invention showing the alternate embodiment of the nozzle assemblies for the embodiment shown in FIG. 4.

In an embodiment, as shown in FIGS. 4 and 5, the lifting means 76 may comprise an armature 86 extending outwardly from a side of the vehicle. The lifting means 76 may comprise a clamping assembly 88 mounted to an end of the armature 86. The clamping assembly 88 selectively clamps around a relatively smaller garbage container 12, such as a substantially cylindrical residential garbage can. The armature 86 lifts the garbage container 12 along the side of the vehicle and tips the garbage container 12 upside down into the washing space 32 and positions the garbage container 12 over at least one of the stanchion members to allow the nozzles 48 on the at least one stanchion member to rinse the interior of the garbage container 12.

In use, the vehicle is driven to the location of the garbage container 12. The lifting means 76 is used to engage the garbage container 12. The lifting means 76 is then used to lift the garbage container 12 and position it upside down in the washing space 32 of the washing bin 16. Nozzles 48 spray fluid from the fluid space 34 onto the exterior and into the interior of the garbage container 12 to clean the garbage container 12. The fluid and debris from the garbage container 12 are then collected by the return assembly 58 which separates the debris from the fluid and returns the fluid to the fluid space 34 to allow the fluid to be reused to clean additional garbage container 12*s*. When the garbage container 12 has been cleaned the lifting means 76 lowers the garbage container 12 to the support surface and disengages the garbage container 12 to permit the vehicle to advance to the next garbage container 12 in need of cleaning.

With respect to the above description then, it is to be realized that the optimum dimensional relationships for the parts of the invention, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A garbage container cleaning system for cleaning and deodorizing a garbage container, the system comprising:

a washing assembly for mounting on a vehicle resting on a support surface, the washing assembly being capable of washing both an interior and an exterior of the garbage container; and a lifting means for lifting the garbage container from the support surface and positioning the garbage container in the washing assembly, said lifting means being mountable on the vehicle with said washing assembly;

wherein said washing assembly comprises a washing bin mountable on the vehicle, said washing bin comprising a perimeter wall and a base wall collectively defining an interior space of said washing bin, an upper edge of said perimeter wall defining an upper opening of said washing bin;

wherein said washing assembly comprises a plurality of nozzle assemblies for directing fluid from said fluid space onto the garbage container positioned in said washing space to clean the garbage container, said plurality of nozzle assemblies being positioned in said washing space of said washing bin;

wherein a portion of said plurality of nozzle assemblies comprises a plurality of stanchion conduits being in fluid communication with said fluid space, a portion of said plurality of stanchion conduits being coupled to said perimeter wall of said washing bin for spraying water onto an exterior of the garbage container, at least one of said stanchion conduits being substantially centrally positioned in said interior space and extending upwardly from said base wall in a substantially free standing manner for spraying water in an interior of the garbage container; and a plurality of nozzles for spraying fluid into said washing space being coupled to each of said stanchion conduits such that said nozzles coupled to said stanchion conduit are in fluid communication with flow in said stanchion conduit.

2. The system as set forth in claim 1, said upper opening and said interior space of said washing bin are sufficiently large to permit the garbage container to be removably inserted into said interior space of said washing bin.

3. The system as set forth in claim 1, wherein said washing assembly comprises a dividing wall coupled to said perimeter wall of said washing bin, said dividing wall dividing said interior space into a washing space and a fluid space, said washing space being for removably receiving the garbage container, said fluid space being in fluid communication with said washing space to allow a fluid in said fluid space to be used to clean the garbage container in said washing space.

4. The system as set forth in claim 3, wherein said washing assembly comprises a plurality of baffle walls positioned in said fluid space for dampening movement of fluid in said fluid space.

5. The system as set forth in claim 4, wherein each of said baffle walls includes at least one aperture extending through the associated one of said baffle walls to permit the fluid to pass through the associated one of said baffle walls to permit a depth of the fluid to remain substantially uniform in said fluid space.

6. The system as set forth in claim 1, wherein a portion of said nozzle assemblies are mounted on said base wall of said interior space and are directed upwardly into said washing space.

7. The system as set forth in claim 1, wherein said nozzles coupled to said stanchion conduit are positioned at divergent angles to said stanchion conduit to allow fluid sprayed from said nozzles to be sprayed into and onto the garbage container.

8. The system as set forth in claim 1, wherein said washing assembly comprises a supply assembly for supplying fluid from said fluid space to said nozzle assemblies, said supply assembly being in fluid communication with said fluid space and said nozzle assemblies.

9. The system as set forth in claim 8, wherein said supply assembly comprises a mixing member for mixing chemical's with the fluid to be supplied to said nozzle assemblies.

10. The system as set forth in claim 1, wherein said washing assembly comprises a return assembly for returning fluid from said washing space to said fluid space when the fluid has been used to clean the garbage container.

11. The system as set forth in claim 10, wherein said return assembly comprises a grinding member for grinding debris washed from the garbage container and collected with the fluid from said washing space, said grinding member being in fluid communication with said washing space.

12. The system as set forth in claim 11, wherein said return assembly comprises a separator member for separating the debris that has been ground up by said grinding member from the fluid, said separator member being in fluid communication with said grinding member for receiving flow from said grinding member.

13. The system as set forth in claim 11, wherein said return assembly comprises at least one return pump being in fluid communication with said separator member for pumping the fluid from said separator member to said fluid space of said washing bin.

14. The system as set forth in claim 13, wherein said return assembly comprises a particulate filter being in fluid communication with said at least one return pump and said fluid space for removing particulate matter from the fluid from said separator member.

15. The system as set forth in claim 1, wherein said washing assembly comprises a flap member configured to engage a lid of the garbage container when the garbage container is positioned in the interior space and being effective to force the lid away from the garbage container to keep the garbage container lid open.

16. The system as set forth in claim 15, wherein said flap member extends upwardly from said base wall at an angle with respect to said base wall and into said interior space of said washing bin.

17. A garbage container cleaning system for cleaning and deodorizing a garbage container, the system comprising:

a vehicle for traveling across a support surface;

a garbage container for receiving garbage, said garbage container having a lid pivotally mounted on a container portion of said garbage container for selectively closing said garbage container to keep garbage in said container portion;

a washing assembly mounted on the vehicle for washing said garbage container, said washing assembly being capable of washing both an interior and an exterior of said garbage container, said washing assembly comprising:

a washing bin being coupled to the vehicle, said washing bin comprising a perimeter wall and a base wall defining an interior space of said washing bin, an upper edge of said perimeter wall defining an upper opening of said washing bin, said upper opening and said interior space of said washing bin being sufficiently large to permit said garbage container to be removably inserted into said interior space of said washing bin;

a dividing wall coupled to said perimeter wall of said washing bin, said dividing wall dividing said interior space into a washing space and a fluid space, said washing space removably receiving said garbage container, said fluid space being in fluid communication with said washing space to allow the fluid in said fluid space to be used to clean said garbage container in said washing space;

a flap member coupled to said perimeter wall of said washing bin, said flap member extending upwardly into said washing space, said flap member extending at an angle with respect to said base wall of said washing bin, said flap member engaging a lid of said garbage container to force the lid away from said garbage container to keep said garbage container lid open when said garbage container is positioned in the washing space;

a plurality of baffle walls for dampening movement of the fluid in said fluid space, said plurality of baffle walls being positioned in said fluid space for defining a plurality of compartments in said fluid space, said plurality of baffle walls being coupled to said perimeter wall and said dividing wall, each of said baffle walls including at least one aperture extending through the associated one of said baffle walls to permit the fluid to pass through the associated one of said baffle walls to permit a depth of the fluid to remain substantially uniform in said fluid space;

a plurality of nozzle assemblies for directing fluid from said fluid space onto said garbage container positioned in said washing space to clean said garbage container, said plurality of nozzle assemblies being positioned in said washing space of said washing bin, said nozzle assemblies being positioned along the perimeter of said washing bin such that said nozzle assemblies are directed into said washing space, said nozzle assemblies being in fluid communication with said fluid space of said washing bin, each of said nozzle assemblies comprising:

at least one stanchion conduit being in fluid communication with said fluid space, said at least one stanchion conduit being coupled to said perimeter wall of said washing bin;

a plurality of nozzles for spraying fluid into said washing space, a portion of said nozzles being coupled to said stanchion conduit such that said nozzles coupled to said stanchion conduit are in fluid communication with flow in said stanchion conduit, said nozzles coupled to said stanchion conduit being positioned at angles to said stanchion conduit to allow fluid sprayed from said nozzles to be sprayed into and onto said garbage container;

a supply assembly for supplying fluid from said fluid space to said nozzle assemblies, said supply assembly being in fluid communication with said fluid space and said nozzle assemblies, said supply assembly comprising:

a supply pump for pumping the fluid from said fluid space to said nozzle assemblies, said supply pump being in fluid communication with said fluid space of said washing bin;

a mixing member for mixing chemicals with the fluid, said mixing member being in fluid communication with said supply pump and said nozzle assemblies;

a pressurizing member for pressurizing the fluid being supplied to said nozzle assemblies after said fluid has passed through said mixing member;

a return assembly for returning fluid from said washing space to said fluid space when the fluid has been used to clean said garbage container, said return assembly comprising:

a drain trough being coupled to said base wall of said washing bin in a manner such that said drain trough is in fluid communication with said washing space, said base wall of said washing bin being angled downwardly towards said drain trough to move debris and fluid dispensed from said nozzle assemblies into said washing space toward said drain trough to collect the fluid, said drain trough having a bottom wall that slopes downwardly to a drain aperture to direct the fluid and the debris collected in said drain trough to said drain aperture;

a grinding member for grinding the debris washed from said garbage container and collected with the fluid from said washing space, said grinding member being coupled to said drain trough such that said grinding member is in fluid communication with said drain aperture of said drain trough;

a separator member for separating the debris that has been ground up by said grinding member from the fluid, said separator member being in fluid communication with said grinding member for receiving flow from said grinding member;

a debris collection member being coupled to said separator member for collecting the debris separated from the fluid by said separator member and storing the debris for disposal;

a return primary pump being in fluid communication with said separator member for pumping the fluid from said separator member to said fluid space of said washing bin;

a particulate filter being in fluid communication with said return primary pump and said fluid space for removing particulate matter from the fluid from said separator member;

a return secondary pump being in fluid communication with said particulate filter and said fluid space to pump the filtered water to said fluid space;

lifting means for lifting said garbage container from the support surface and positioning said garbage container in the washing space of the washing bin, said lifting means being operationally coupled to the vehicle, said lifting means comprising:

a pair of arms being pivotally coupled to said vehicle such that said arms are pivotable with respect to said vehicle;

actuating means for pivoting said pair of arms with respect to said vehicle, said actuating means comprising a pair of hydraulic piston-cylinder assemblies, each of said hydraulic piston-cylinder assemblies being mounted on one of said arms;

a plurality of forks for inserting into receiving slots of said garbage container, said forks being coupled to said arms to lift said garbage container over the vehicle and into said washing space of said washing bin; and a pair of connecting members for mounting said forks to said arms, said connecting members extending between said arms and said forks, said connecting members extending through a pair of arcuate cutouts extending through said perimeter wall of said washing bin to permit said arms to be positioned outside of said washing bin when said forks and said garbage container are positioned in said washing space of said washing bin.

* * * * *